US005787573A

United States Patent [19]

Pytel et al.

[11] Patent Number: 5,787,573

[45] Date of Patent: Aug. 4, 1998

[54] METHOD OF MAKING AIR CONDITIONER RECEIVER DRYER

[75] Inventors: Norbert Pytel, Waynesboro, Va.; Frank Mastromatteo, Kettering, Ohio; Matthew J. C. Mastromatteo, Centerville, Ohio; Carl R. Espey, Fairview Park, Ohio

[73] Assignee: Neuman USA Ltd., Verona, Va.

[21] Appl. No.: 609,596

[22] Filed: Mar. 5, 1996

[51] Int. Cl.[6] ..... B23P 15/26

[52] U.S. Cl. ..... 29/890.06; 62/503

[58] Field of Search ..... 29/890.06, 890.03, 29/428, 505; 62/503

[56] References Cited

U.S. PATENT DOCUMENTS

| | | | |
|---|---|---|---|
| 3,344,506 | 10/1967 | Bottum et al. | 29/407 |
| 3,488,678 | 1/1970 | Wagner | 62/503 |
| 4,496,378 | 1/1985 | Kish | 55/316 |
| 4,611,750 | 9/1986 | Kish | 29/890.06 |
| 4,619,673 | 10/1986 | Cullen et al. | 55/387 |
| 4,707,999 | 11/1987 | Ohta et al. | 62/474 |
| 4,866,951 | 9/1989 | Masterson, II | 62/503 |
| 4,938,037 | 7/1990 | Carlisle, Jr. | 62/503 |
| 5,048,309 | 9/1991 | Carlisle, Jr. | 62/503 |
| 5,075,967 | 12/1991 | Bottum | 29/890.06 |
| 5,177,982 | 1/1993 | Plemens | 62/503 |
| 5,179,780 | 1/1993 | Wintersteen et al. | 29/890.07 |
| 5,179,844 | 1/1993 | Lyman et al. | 62/503 |
| 5,184,479 | 2/1993 | Koberstein et al. | 62/503 |
| 5,191,775 | 3/1993 | Shiina et al. | 62/503 |
| 5,245,842 | 9/1993 | Searfoss et al. | 62/474 |
| 5,282,370 | 2/1994 | Kiblawi et al. | 62/503 |
| 5,347,829 | 9/1994 | Newman | 62/474 |
| 5,365,751 | 11/1994 | Mikesell et al. | 62/298 |
| 5,375,327 | 12/1994 | Searfoss et al. | 29/890.06 |
| 5,419,157 | 5/1995 | Kiblawi et al. | 62/503 |
| 5,425,249 | 6/1995 | Lyman | 62/471 |
| 5,491,983 | 2/1996 | Hamilton et al. | 62/503 |
| 5,651,266 | 7/1997 | Hutchison et al. | 29/890.06 |

FOREIGN PATENT DOCUMENTS 685694 12/1995 European Pat. Off. .

OTHER PUBLICATIONS

Copy of International Search Report for PCT/US97/03502.

*Primary Examiner*—Irene Cuda

*Attorney, Agent, or Firm*—Rankin, Hill, Porter & Clark LLP

[57] ABSTRACT

A receiver dryer for an automobile air conditioning system is produced by physically working a metal blank by impact extrusion to form a receptacle with a continuous side wall and an end wall at one end having a relatively thick mounting block included therein. The mounting block is drilled to form access ports for fluid refrigerant. A length of tubing is inserted through the open end of the receptacle and one end thereof is connected to one of the ports. A desiccant bag is also inserted. Then the upper portion of the continuous side wall is physically deformed to close the open end and seal the interior of the receptacle.

1 Claim, 3 Drawing Sheets

METHOD OF MAKING AIR CONDITIONER RECEIVER DRYER

BACKGROUND OF THE INVENTION

This invention relates to air conditioning systems such as those installed in automotive vehicles, and especially to a receiver dryer (frequently referred to as a "dehydrator") to be placed in the system to receive partially vaporized refrigerant and to provide a sealed chamber for accumulated vapor at the top of the chamber and accumulated liquid at the bottom. More particularly, the invention relates to an improved process for making a receiver dryer on a high volume production basis.

In most air conditioning systems, either an accumulator or a receiver dryer is installed in the refrigerant circuit to remove moisture from the refrigerant and to serve as a storage chamber for liquid refrigerant when the system is shut down. The refrigerant flow path in most air conditioning systems, comprises what are termed a "high side" and a "low side". The high side of the flow path or circuit extends from the compressor through the condenser to the expansion valve. On the high side, the refrigerant fluid is at a relatively high pressure (e.g. 200 psig) and high temperature (e.g. 150° F.). The low side of the flow path extends from the expansion valve through the evaporator and back to the compressor. On the low side, the refrigerant fluid is at a relatively low temperature (e.g. 50° F.) and pressure (e.g. 40 psig). The temperature of the refrigerant, however, will of course, change significantly when passing through the condenser on the high side and through the evaporator on the low side.

If a receiver dryer (dehydrator) is used in the system, it is located between the condenser and the expansion valve in the high side of the system. High pressure fluid, generally a mix of gas and liquid, enters the sealed receiver dryer chamber through an inlet port (generally at the bottom of the chamber) and preferably passes through a length of tubing within the chamber to an outlet end located at the bottom of the chamber. Accordingly, liquid collects at the bottom and gas at the top. A quantity of desiccant located in the chamber removes moisture from the refrigerant. An outlet port in the bottom of the chamber receives accumulated liquid refrigerant which moves on to the expansion valve.

In the case where an accumulator is used, the device is located between the evaporator and the compressor, in the low side of the system. This particular connecting line is sometimes called the suction line. Low pressure fluid (generally a mix of liquid and gas) enters the sealed chamber where a quantity of desiccant removes moisture. A length of tubing within the chamber directs the incoming fluid to the lower level so that the liquid accumulates in the bottom part of the chamber while the gas accumulates at the top. Fluid exiting the chamber through an outlet port at the top is essentially a gas that flows on to the compressor.

Both types of devices require certain basic features. Both must provide a sealed chamber containing a supply of desiccant and a length of tubing, and both must have inlet and outlet ports to be connected to fluid lines.

Prior art devices have been fabricated in several ways. One technique uses two separate chamber-defining sections, one of which receives the desiccant and tube length initially. The other section is then connected to the first at an intermediate seam and tightly bonded to seal the chamber. Also, one of the sections is usually provided with both the inlet and outlet ports. Usually, the ports are formed in the side walls and extend radially relative to the longitudinal axis of the chamber. The ports are provided with fittings welded or bonded to the wall of the chamber.

Another technique is to form an open-ended cylindrical body and then to close one end by securing an end plate to the cylindrical wall, such as by welding or some form of bonding. Once the desiccant and tube length are installed in the interior of the cylindrical body, the open end is closed by physical working. The inlet and outlet ports are generally formed in the end plate which is usually located at the top of the unit when it is installed.

All of these processes are time consuming and costly and require several separate operations. An efficient, economical method of manufacture has not been available.

Another problem with prior art receiver dryers and accumulators is that automobile designs provide ever decreasing space for mounting the device. Radial fittings require too much space in the vehicle engine compartment. Also, where the inlet and outlet lines connect at the top of the unit, the location of fluid lines becomes awkward. An ideal solution is to have the fluid lines connected at the bottom of the device and to have the mounting arrangement for the unit also located at the bottom. A satisfactory design for this type of installation, however, has not been available.

The method and product of the present invention, however, resolve the difficulties described above and afford other features and advantages heretofore not obtainable.

DESCRIPTION OF THE PREFERRED EMBODIMENT

The present invention provides a receiver dryer (or accumulator dryer) of improved construction and which contains a minimum number of components that may be assembled with a minimum of procedural steps.

In accordance with method of the present invention, a metal blank (typically an aluminum alloy) is impact extruded to form an open receptacle with a continuous side wall formed about a central axis, and an end wall that closes one end of the continuous side wall. The end wall has a relatively thick, integral mounting block formed therein. The mounting block is then drilled to form inlet and outlet ports for fluid refrigerant.

Then a length of tubing is inserted through the open end of the enclosure and connected to the inlet port. Also, a quantity of desiccant is inserted to absorb any condensed moisture that may be in the liquid refrigerant.

Finally, the open end of the receptacle is physically worked by one of a number of available processes to close the end and seal the interior of the device.

The resulting product may then be connected in the circuit by fluid fittings located at the bottom of the unit.

DESCRIPTION OF THE PREFERRED EMBODIMENT

Figure 1:
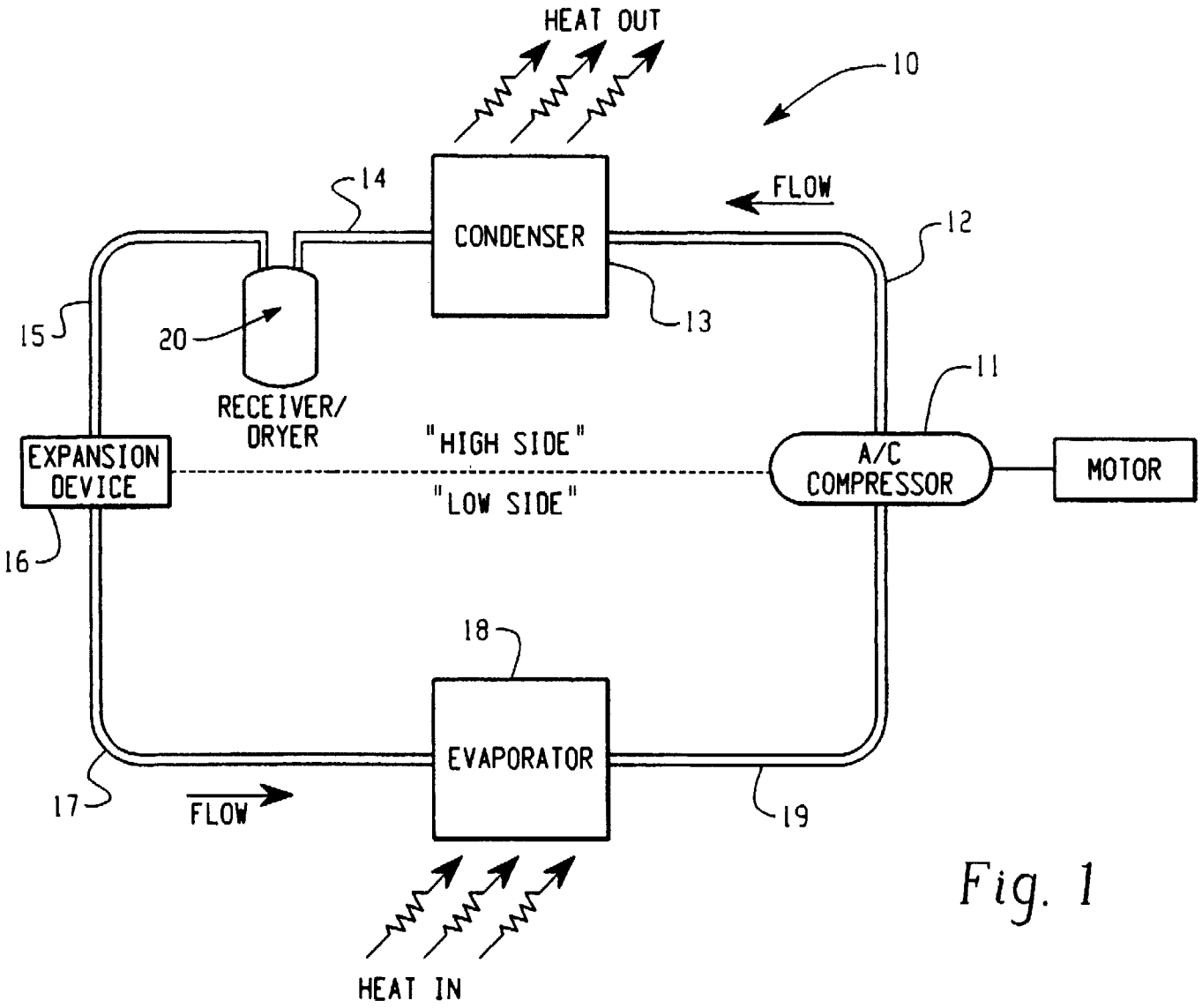
FIG. 1 is a schematic diagram of a typical vehicle air conditioning system using a receiver dryer embodying the invention and made in accordance with the method of the invention.

Referring initially to FIG. 1, there is shown a typical vehicle air conditioning system 10 utilizing a receiver dryer component 20 (dehydrator) made in accordance with the method of the invention. The system includes as its primary components, a compressor 11 connected through a high pressure fluid line to a condenser 13. The condenser is connected through a relatively high pressure line 14 to the inlet fitting of the receiver dryer 20. An outlet line extends from the outlet fitting of the receiver dryer 20 to an expansion valve 16. The above portion of the refrigerant flow path is referred to as the high pressure side or "high side" of the system.

A low pressure line 17 connects the expansion valve 16 to the evaporator 18. Another low pressure line or "suction line" connects the evaporator 18 back to the compressor 11.

In accordance with the standard system operation, the condensing of the compressed gas in the condenser 13 results in the extraction of heat energy from the refrigerant while the evaporation of the condensed refrigerant to form gas at low pressure in the evaporator 18 results in the absorption of heat energy as indicated by the diagonal arrows in FIG. 1.

Figure 2:
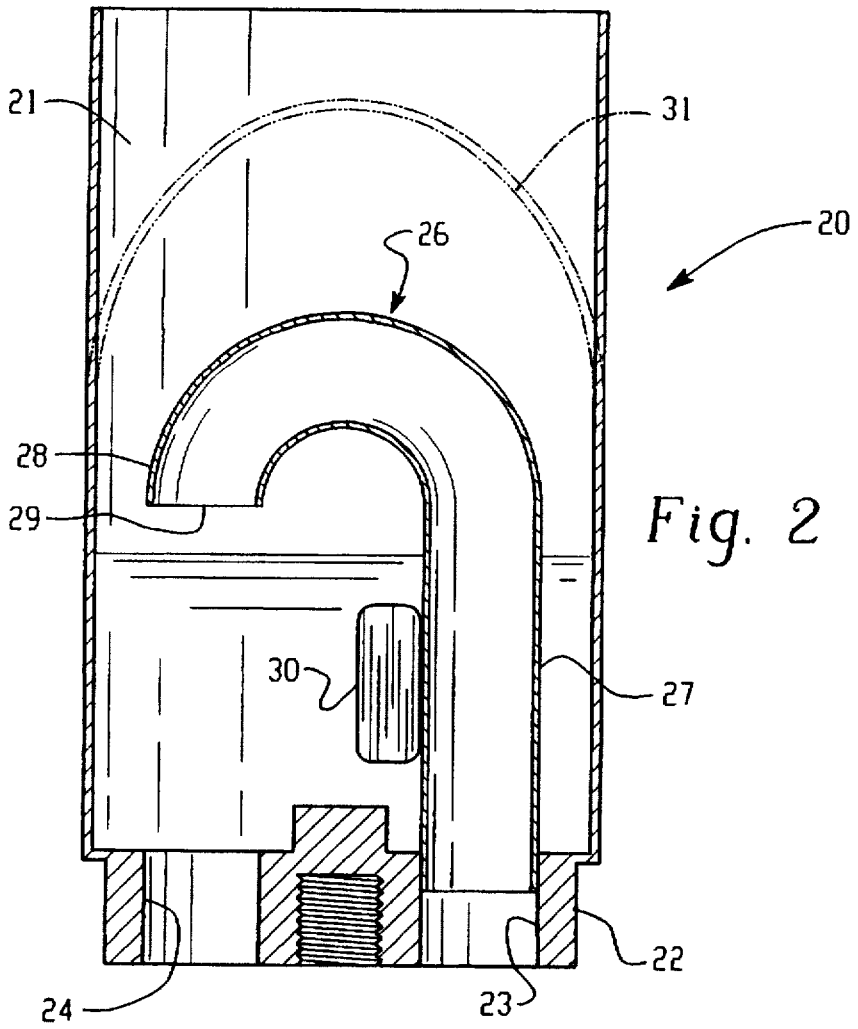
FIG. 2 is a sectional view of a receiver dryer shown schematically in FIG. 1, showing the side wall prior to closure in solid lines, and after closure of the upper end in dashed lines.

Referring to FIG. 2, the receiver dryer made in accordance with the method of the present invention, defines a sealed chamber adapted to receive the refrigerant generally as a mixture of liquid and gas. The liquid collects in the bottom of the sealed chamber and gas accumulates in the upper portion. The device has a continuous cylindrical side wall 21 and an end wall with a relatively thick integral mounting block 22 formed therein. The block 22 has an inlet port 23, and an outlet port 24, drilled therethrough.

The cylindrical wall 21 is formed about a central axis and a mounting socket 25 is drilled and tapped in the mounting block 22 centered at the central axis. This enables a mounting stud to be threaded from below into the socket 25 to connect the unit 20 to a manifold block in a vehicle engine compartment.

Located within the unit 20 is a length of tube 26 having a slightly longer leg 27 on one side and a somewhat shorter leg 28 on the other side. The end of the leg 27 fits into the inner portion of the inlet port 23.

A desiccant bag 30 containing a moisture absorbing material is located in the portion of the chamber generally containing the liquid refrigerant. Once the tube 27 and desiccant bag 30 have been inserted through the open end of the continuous side wall 21, the open end is closed and sealed by physical working to form a domed-shaped portion 31 as shown in dashed lines in FIG. 3.

THE PROCESS

Figure 3:
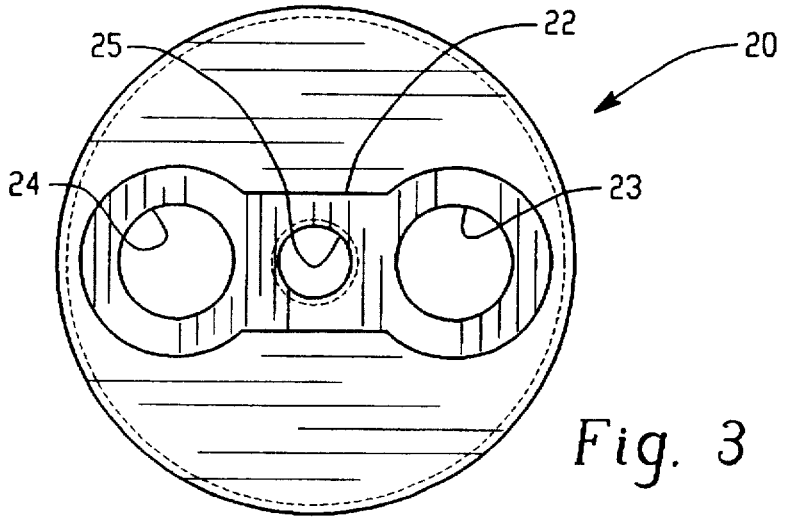
FIG. 3 is a bottom elevation of the receiver dryer of FIG. 2.
Figure 4A:
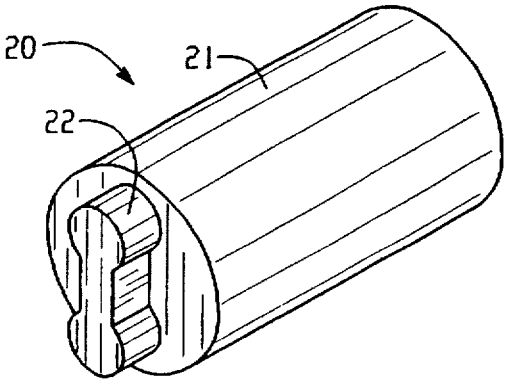
FIG. 4 is a flow diagram generally in schematic form illustrating the various steps of the method of the invention.
Figure 4B:
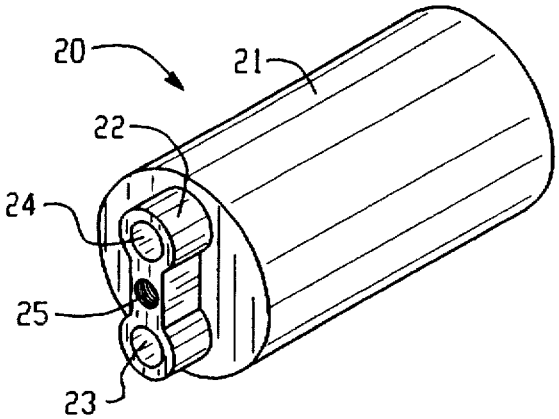
Figure 4C:
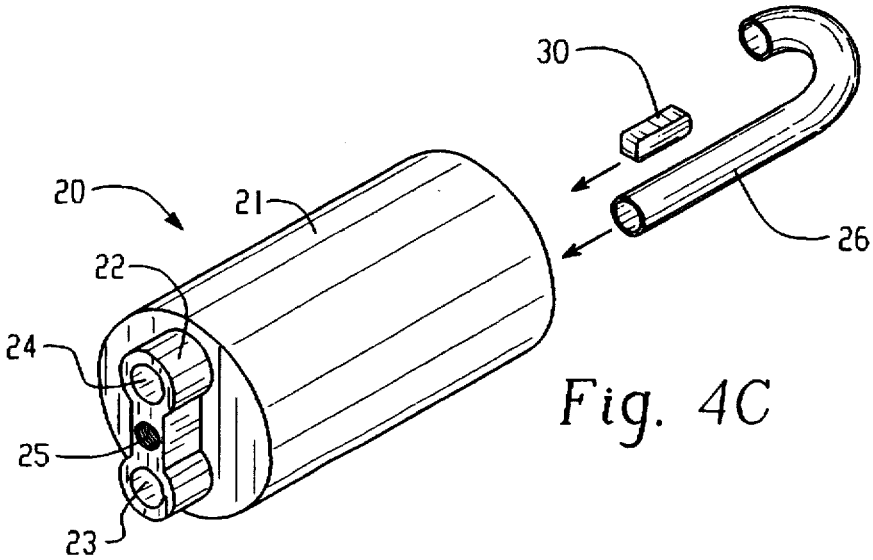
Figure 4D:
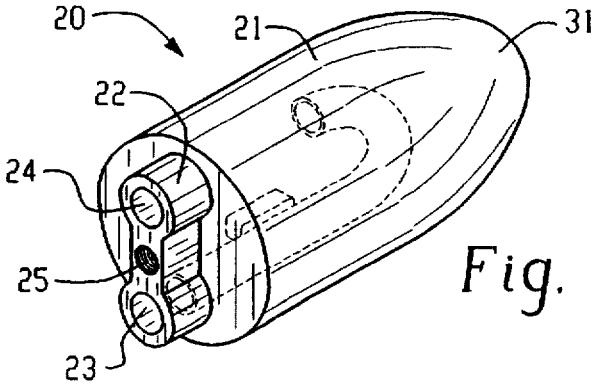

In accordance with the method of the present invention, a metal blank, such as an aluminum alloy, for example, is formed by an impact extrusion process of the type well known in the art to provide the initial product 20 (FIG. 2) for subsequent steps. The initial piece has a cylindrical side wall 21 formed about a central axis and an end wall having a relatively thick mounting block 22 formed thereon and extending outwardly (or downwardly). The end block as best shown in FIG. 3 is drilled to form the inlet and outlet ports 23 and 24. Also, the mounting block 22 is drilled and tapped to form a central threaded socket for a mounting stud.

Then the tube 27 and desiccant bag are inserted in the open end of the piece in the manner illustrated in FIG. 2 so that the leg 27 of the tube 26 registers with the inlet port 23. The desiccant bag 30 is also inserted through the open end and preferably secured to the tube 26. Finally, the open end of the receptacle is physically deformed to a closed and sealed condition.

The resulting product which has been formed by a more efficient process using less time and material, is then assembled in an air conditioning system as shown in FIG. 1.

While the invention has been shown and described with respect to specific embodiments of the method and product of the invention, this is intended for the purpose of illustration rather than limitation and other variations and modifications of the specific product and process herein shown and described will be apparent to those skilled in the art all within the intended spirit and scope of the invention. Accordingly, the patent is not to be limited in scope and effect to the specific product and process herein shown and described nor in any other way that is inconsistent with the extent to which the progress in the art has been advanced by the invention.

We claim:

1. A method of making a fluid refrigerant receiving and accumulating device for use in an air conditioning system comprising the steps of:

working a metal blank by impact extrusion to form a receptacle with a continuous side wall formed about a central axis and an end wall at one end with a relatively thick integral mounting block included therein;

drilling said mounting block to form ports for fluid refrigerant;

inserting a length of tubing through the open end of the said receptacle and connecting one end thereof to one of said ports; and physically deforming said continuous side wall adjacent said open end of said receptacle to close said end and seal the interior of the said receptacle.

* * * * *